US005092261A

United States Patent [19]

Bertrand

[11] Patent Number: 5,092,261

[45] Date of Patent: Mar. 3, 1992

[54] BOAT ANCHOR

[76] Inventor: Ronald J. Bertrand, W220 S1571 Spring Dale Rd., Waukesha, Wis. 53186

[21] Appl. No.: 566,069

[22] Filed: Aug. 13, 1990

[51] Int. Cl.[5] ..... B63B 21/24

[52] U.S. Cl. ..... 114/304; 114/303

[58] Field of Search ..... D12/215; 114/294, 309, 114/301-304; 52/162, 163, 155

[56] References Cited

U.S. PATENT DOCUMENTS

| | | | |
|---|---|---|---|
| 2,526,214 | 10/1950 | Faraone | 114/303 |
| 2,741,209 | 4/1956 | Recuendorf | 114/303 |
| 4,403,564 | 9/1983 | Garvin | 114/303 |
| 4,596,202 | 6/1986 | Brewster | 114/303 |
| 4,823,721 | 4/1989 | Penny | 114/303 |

*Primary Examiner*—Joseph F. Peters, Jr.
*Assistant Examiner*—Clifford T. Bartz
*Attorney, Agent, or Firm*—Ire Milton Jones

[57] ABSTRACT

A boat anchor with a fixed pair of flukes on the end of the shank. For the purpose of illustration, the shank is square on the lower end and around on the opposite end. A pair of movable flukes are connected with means defining a central opening which, for the purpose of illustration, is square and received on the shank to fix a position of the movable flukes relative to the fixed flukes when in the lower position, and rotatable on the round portion of the shank to selectively and alternatively position the fixed and movable flukes. Accordingly, the fixed and movable flukes are in a right-angle position when in operation and can be adjusted to a parallel position when in storage.

11 Claims, 1 Drawing Sheet

BOAT ANCHOR

The use of a square shank with a rounded portion to allow adjustment from a parallel to a normal position of the flukes is used to illustrate the invention. However, as long as the relationship of the flukes are fixed or locked in one position and rotatable on another portion of the shank, this adequately covers the applicant's invention.

This invention relates to a boat anchor and, more particularly, to a pair of fixed flukes on the crown or lower end of a shank and a pair of secondary flukes connected by means defining a central opening received on the shank to provide a means whereby the movable flukes can be positioned in the operating position or the storage position. For the purposes of illustration, the shank and the opening in the movable flukes is square with a rounded portion on the shank to allow rotation from the parallel to the perpendicular position or operating position.

Also for purposes of illustration, a square shank having a round portion has been used to illustrate the applicant's invention. If the square portion were octagonal, triangular or other configuration, the purpose of the invention could be accomplished.

Boat anchors are often encumbersome to carry on a boat and occupy space needed for other purposes. Accordingly, an ancbor that is collapsible in the storage position and will require a minimum of space and is conveniently and easily adjustable to the operating position is an advantage.

The British Patent No. 980,400, the Reckendorf U.S. Pat. No. 2,741,209 and the Brewster U.S. Pat. No. 4,596,202, all show collapsible anchors, but fail to show the structural configuration of the shank and adjustment shown in the applicant's invention.

Applicant provides for a simple but rugged anchor, which is easily adjustable from the operating position to the storage position, or vice versa.

OBJECTS OF THE INVENTION

It is an object of this invention to provide a boat anchor which is adjustable from an operating position to a storage position, and vice versa.

It is another object of this invention to provide a boat anchor having a square central shank and a circular portion carrying fixed flukes on the shaft and movable flukes slidably mounted on the shank. A portion of the shank is square to fix the relative position of the fixed and movable flukes, and a portion is circular to allow rotational movement of the movable flukes relative to the fixed flukes.

It is a further object of this invention to provide a spring lock to lock the flukes in their operating position.

It is a further object of this invention to provide an anchor with a pair of fixed flukes and a pair of movable flukes which are movable from a right-angle position for operation to a parallel position in the storage position.

The objects of the invention are accomplished in a boat anchor which has fixed flukes positioned opposite to each other at the crown or lower end of the shank. The shank is square adjacent to the crown and extends upwardly to a portion which is rounded to allow adjustment of the movable pair of flukes from the right-angle position to the fixed flukes to a parallel position in the storage position. The secondary or movable flukes are connected with the structure defining a square opening received on the shank which locks with the shank in its operating position and is rotatable when moved axially on the shank to the upper portion of the shank.

A refinement of the invention is the use of a spring lock which retains the movable flukes in their operating position. The upper end of the shank is provided with an eyelet which can be connected to the anchor chain.

Referring to the drawing, the preferred embodiment of the invention is illustrated:

Figure 3:
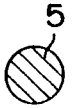
FIG. 3 is a cross sectional view taken on the line 3—3.
Figure 2:
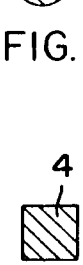
FIG. 2 is a cross section view taken on the line 213 2.
Figure 1:
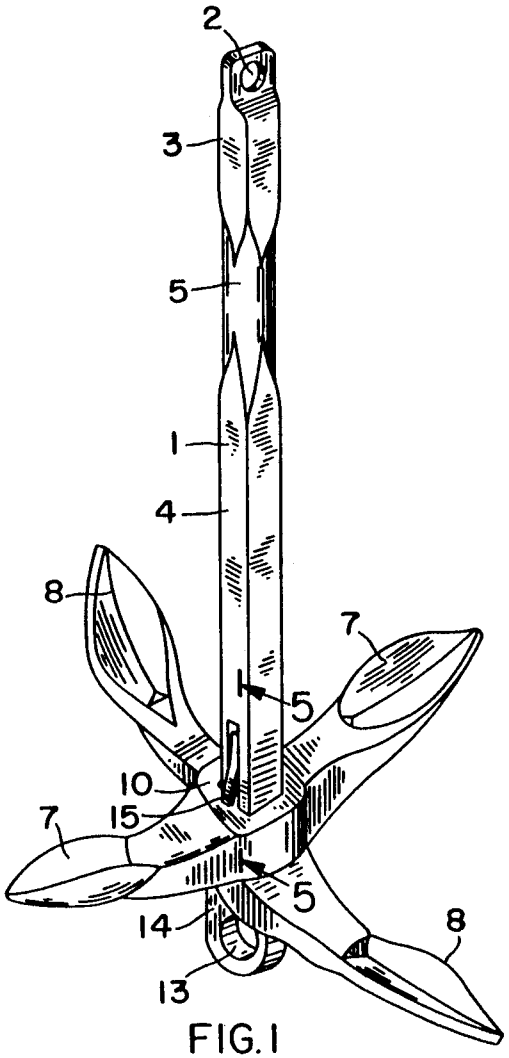
FIG. 1 illustrates a three-dimensional view of the anchor in the operation position.

FIG. 1 shows a three dimensional view of the anchor in its operating position. The anchor includes a s shank 1 with an eyelet 2 for connection to an anchor chain. The lower portion of the shank has a square cross sectional configuration, as shown in FIG. 2. As shown in FIG. 2, 4 of the shank also has a square cross sectional configuration, as shown in FIG. 2. The intermediate portion 5 is circular, as shown in FIG. 3, and allows rotational movement of the movable flukes 7 relative to the fixed flukes 8.

In the operating position, a spring latch 9 abuts against the facing 10 of the movable flukes 7. The spring 11 is fastened in a slot 15 by the screw 12. This latch is a refinement of the invention and the device will work quite satisfactorily without it, although it can be added to the device and it automatically locks the movable flukes 7 with the flukes 8.

For the purposes of illustration, a shank having a square configuration and a round portion 5 is used. The square configuration might be triangular, octagonal or any configuration which prevents relative rotation between the movable flukes 7 and the fixed flukes 8.

The eyelet 2 is provided on the upper end of the shank for connection to the anchor chain, or may be used for mounting the anchor on the wall or bulkhead of a boat or ship. Also provided is an eyelet 13 and a crown 14. This can also be used in mounting the anchor in the storage position.

The anchor operates in the following described manner.

Figure 6:
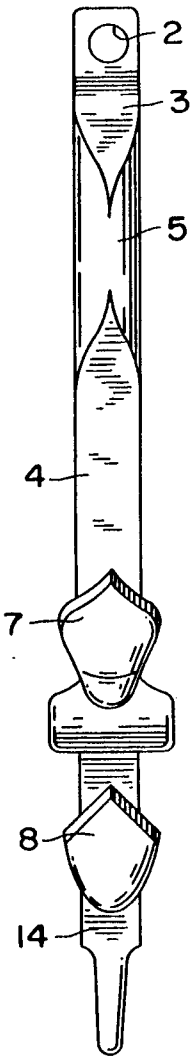
FIG. 6 is a top view of the anchor shown in FIG. 4.
Figure 5:
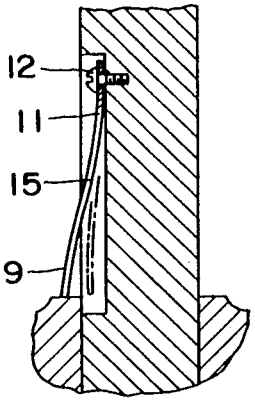
FIG. 5 is a cross section view taken on the line 5—5 of FIG. 1.
Figure 4:
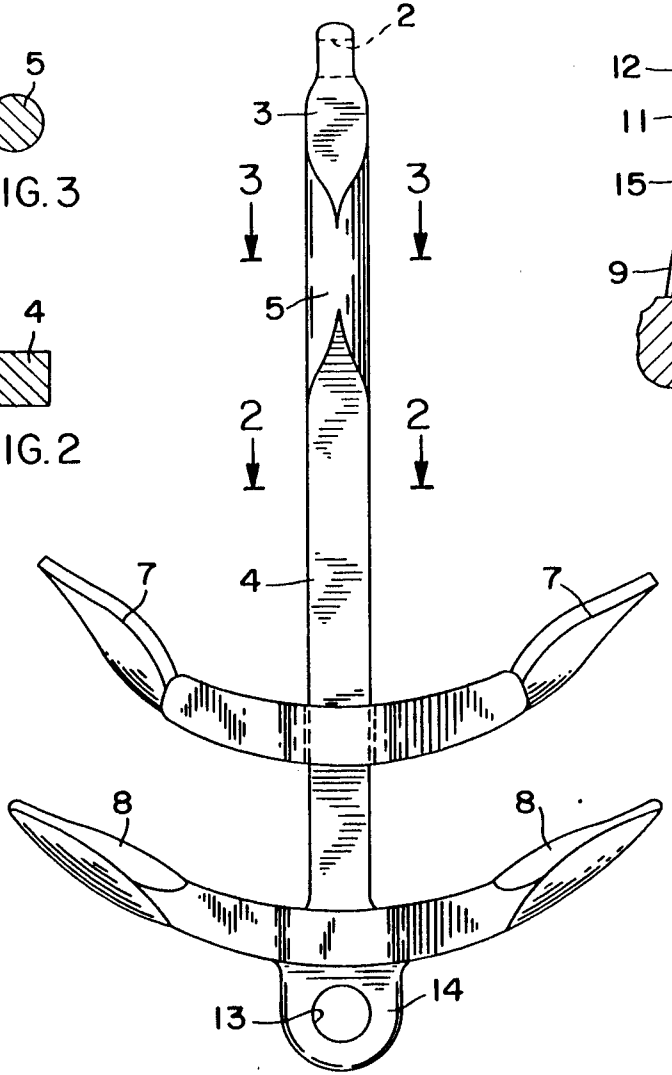
FIG. 4 is a side elevation view showing the anchor in the storage position, with the pair of fixed flukes parallel with the pair of movable flukes.

The anchor normally in its storage position is shown in FIGS. 4 and 6. The movable flukes 7 are held in a parallel relationship with a fixed fluke 8 due to the positioning of the movable flukes, which is accomplished by rotation on the round portion 5 of the shank 1.

The movable flukes 7 may be positioned on either end of the shank, since they are both square. The position shown in FIGS. 4 and 6, however, shows that the fixed flukes 8 and movable flukes 7 are in a parallel position and fit neatly against the side of a boat with a minimum of space.

When, however, the anchor is ready for use, the movable flukes 7 are movable to the round portion 5 of the shank 1. The movable flukes 7 are then rotated to a position normal with the fixed flukes 8 and then the movable flukes are moved to the position shown in FIG. 1. The latch 9 automatically locks the flukes in this position and the anchor is ready for use. To remove the anchor and readjust the movable flukes 7, the latch 9 is depressed and the movable flukes 7 are free to move along the shank 1 to rotate to the storage position.

The embodiment of the invention in which an exclusive property or privilege is claimed is defined as follows:

1. A two-piece boat anchor comprising:

a shank with fixed flukes on said shank and a latch defining one piece;

movable flukes slidably mounted on said shank defining a second piece;

means defining an opening in said movable flukes receiving said shank;

means non-rotatably locking said movable flukes with said shank on the lower end of said shank, when said anchor is in an operating position, said latch fixed to said shank axially locking said movable flukes on said shank in the operation position;

means on the upper portion of said shank to allow rotatably moving said movable flukes from said operating position to a storage position.

2. A boat anchor comprising:

a shank;

a pair of fixed flukes integral with said shank extending transversely from the lower end of said shank;

a pair of movable flukes with connecting means defining a central opening receiving said shank and slidably mounted on said shank;

interlocking means non-rotatably locking said flukes and an automatic latch on said shank automatically axially locking said movable flukes and said fixed flukes on the lower portion of said shank;

means allowing rotatably moving of said movable flukes on said shank relative to said fixed flukes on the intermediate portion of said shank.

3. A boat anchor comprising:

a shank;

means defining a square cross section on the lower portion of said shank and a circular cross section on an upper portion of said shank;

a pair of fixed flukes on the lower end of said shank;

a pair of movable flukes connected by means defining a central opening of square configuration receiving said shank;

said movable flukes thereby adjustable from an operating position with the movable flukes normal to the fixed flukes, to a storage position by rotation on said round portion of the shank whereby said movable flukes are in a parallel relationship to said fixed flukes and vice versa;

and a latch to automatically hold the flukes in the selected position.

4. A boat anchor as set forth in claim 1, including an automatic latch device on said shank for latching said movable flukes in fixed position of said shank.

5. A boat anchor as set forth in claim 1, including a spring latch for automatically retaining said movable flukes in their operation position.

6. A boat anchor as set forth in claim 1, wherein said fixed flukes include a pair of flukes and said movable flukes include a pair of flukes.

7. A boat anchor as set forth in claim 1, including an eyelet at the upper end of said shank for connection to an anchor chain.

8. A boat anchor as set forth in claim 2, wherein said flukes include hooks.

9. A boat anchor as set forth in claim 3, including an eyelet at the lower end of said shank for mounting on a wall in the storage position.

10. A boat anchor as set forth in claim 1, wherein said shank defines a square configuration at its lower portion and an upper portion defining a circular configuration to provide adjustability of said anchor.

11. A boat anchor as set forth in claim 2, including a shank having a square cross sectional configuration and a portion defining a round configuration, to thereby provide adjustable means to adjust said movable flukes to a parallel position and to a right-angular position relative to said fixed flukes.

* * * * *